US006907338B2

(12) United States Patent
Frankl et al.

(10) Patent No.: US 6,907,338 B2
(45) Date of Patent: Jun. 14, 2005

(54) CONTROLLER AND CONTROL METHOD FOR INJECTION USING FUNCTION MAP

(75) Inventors: Jason Paul Frankl, Stanmore (GB); Alan Chow, Hertfordshire (GB); Vidya Shankar Somasundaram, London (GB); Edward Thomas Williams, London (GB)

(73) Assignee: Delphi Technologies, Inc., Troy, MI (US)

( * ) Notice: Subject to any disclaimer, the term of this patent is extended or adjusted under 35 U.S.C. 154(b) by 21 days.

(21) Appl. No.: 10/388,248

(22) Filed: Mar. 13, 2003

(65) Prior Publication Data

US 2004/0000294 A1 Jan. 1, 2004

(30) Foreign Application Priority Data

Mar. 16, 2002 (GB) ..... 0206259

(51) Int. Cl.[7] ..... F02D 41/24
(52) U.S. Cl. ..... 701/104; 123/480
(58) Field of Search ..... 701/104, 102, 701/115; 123/480, 486

(56) References Cited

U.S. PATENT DOCUMENTS 4,995,367 A * 2/1991 Yamauchi et al. ..... 123/494
5,863,275 A * 1/1999 Nozaki et al. ..... 477/110
6,273,067 B1 8/2001 Bazinet ..... 123/458
6,328,014 B1 12/2001 Bradshaw ..... 123/300
6,546,419 B1 4/2003 Humpleman et al. ..... 709/223
6,578,555 B2 6/2003 Sykes ..... 123/479
6,622,691 B2 9/2003 Bagnasco et al. ..... 123/295

FOREIGN PATENT DOCUMENTS

EP 1 344 921 A2 * 9/2003 ..... F02D/41/24

* cited by examiner

*Primary Examiner*—Hieu T. Vo
(74) *Attorney, Agent, or Firm*—David P. Wood

(57) ABSTRACT

A method of controlling an injector or the like suitable for use in an internal combustion engine, includes providing a first data map having a plurality of first data map points, each of the first data map points representing a first data map output value, and providing a function map comprising a second data map having a plurality of second data map points, each corresponding to a respective one of the first data map points, and wherein the second data map is divided into at least a first-type data map region containing second data map points representing second data map output values only of a first type and a second-type data map region containing second data map points representing second data map output values only of a second type, wherein a portion of the second data map defines a hysteresis region. The method also includes determining an operating point on an operating path within the second data map in dependence upon first and second engine operating parameters and determining a control function for the injector based on a first data map output value determined from the first data map and the second data map output value determined from the second data map, in dependence upon whether the operating point in the second data map lies in a part of the first-type data map region which is outside the hysteresis region, or whether the operating point in the second data map lies in a part of the first-type data map region which is within the hysteresis region.

21 Claims, 7 Drawing Sheets

CONTROLLER AND CONTROL METHOD FOR INJECTION USING FUNCTION MAP

FIELD OF THE INVENTION

The present invention relates to a method for controlling operation of an injector for use in an internal combustion engine and, in particular, to a control method implementing a function map. The invention also relates to a controller for performing the control method, for example an engine controller, and additionally to a carrier medium carrying a computer readable code for controlling a processor or computer to carry out said control method.

BACKGROUND OF THE INVENTION

The injectors used in fuel injection systems are generally controlled electrically by means of a current waveform applied to the injector. The properties or shape of the waveform applied to the injectors determines the type of injection performed by the injectors. For example, a first waveform may be arranged to cause the injector to generate a pilot injection followed by a single main injection while a second waveform may be arranged to generate a single main injection with no preceding pilot injection.

In order to optimise the operation of the injectors, the waveform must be arranged to start and end at the correct time within the injection cycle. The start and end times for each type of waveform will generally vary in dependence on the instantaneous operating condition of the engine and in particular on the engine speed and the fuel demand or engine load. Moreover, the start and end times for a given operating condition may be different for each type of injection cycle.

Values representing the start time and the duration of the waveform, the latter effectively defining, in conjunction with the start time, the end time for the waveform, are called or calculated by means of one or more maps stored in a memory within the engine controller or management system.

Each map generally comprises a two-dimensional table having ordinate and abscissa values representative of fuel demand (engine load) and engine speed. Each point in the table is an output value representative of a start time for the waveform for a given combination of engine speed and load (hereafter referred to as an engine "condition"). For an engine condition which does not correspond to a discrete point in the table, an output value is derived by interpolating from surrounding points in the table. The interpolated output value is used by an algorithm to generate the appropriate current waveform with the correct start time. A similar table is used to derive the required duration of the waveform, thereby to define the correct end time for the waveform.

A problem with the above-described system is that, owing to the complexity of modern injectors and their ability to perform more than one injection or part injection per cycle, the use of different types of injection cycle (i.e. different combinations of injections or part injections) during certain parts of the engine operating envelope means that at least a pair of maps (one for calculating the start time of the wave form and one for calculating its duration) is required for each type of injection cycle. This is highly wasteful of the memory within the engine management system or controller.

The present invention seeks to address the above problem.

SUMMARY OF THE INVENTION

According to a first aspect of the present invention, there is provided a method of controlling an injector or the like suitable for use in an internal combustion engine, including:

providing a first data map having a plurality of first data map points, each of the first data map points representing a first data map output value, providing a function map comprising a second data map having a plurality of second data map points, each corresponding to a respective one of the first data map points, wherein the second data map is divided into at least a first-type data map region containing second data map points only of a first type and a second-type data map region containing second data map points only of a second type and wherein a portion of the second data map defines a hysteresis region, and determining an operating point on an operating path within the second data map in dependence upon first and second engine operating parameters and determining a control function for the injector based on a first data map output value determined from the first data map and a second data map output value determined from the second data map, in accordance with the following criteria:

a) if the operating point in the second data map lies in a part of the first-type data map region which is outside the hysteresis region, the second data map output value is output from the first-type data map region and the first data map output value is interpolated from first data map output values of the first data map points adjacent to or neighbouring the first data map point corresponding to the operating point in the second data map; or b) if the operating point in the second data map lies in a part of the first-type data map region which is within the hysteresis region, then:

i) if the operating point in the second data map entered the hysteresis region from a previous operating point on the operating path within the first-type data map region then the second data map output value is output from the first-type data map region and a first data map output value is interpolated from the first data map output values of the first data map points adjacent to or neighbouring the first data map point corresponding to the operating point in the second data map; but ii) if the operating point in the second data map entered the hysteresis region from a previous operating point on the operating path within the second-type data map region, then the second data map output value is output from the second-type data map region and the first data map output value is extrapolated from the first data map output values of the first data map points adjacent to the first data map point corresponding to the previous operating point in the second data map.

In one embodiment of the invention, the method includes determining whether a predetermined number of second data map points adjacent to or neighbouring the current operating point represent second data map output values of like type, and whether said predetermined number of second data map points are of the same type as when the operating point was last outside the hysteresis region. If they are, criteria (a) and (b) are followed, but if they are not then the method includes searching for a data map region of different type from which to derive the first data map output values for extrapolation.

The method may also include performing a search function including determining a direction of the previous operating point relative to a current operating point and analysing the type of data map region in said direction to check whether a predetermined number of the data map points in said region represent second data map output values of like first or second type and, (iii) if at least the predetermined number of second data map points in said region in said direction represent second data map output values of like first or second type then the second data map output value is determined in accordance with (b)(i) or (ii), but (iv) if less than the predetermined number of second data map points in said region in said direction represent second data map output values of like first or second type then the type of data map region in at least one further direction is analysed until a data map region having at least the predetermined number of second data map points representing second data map output values of like type is found, and then the second data map output value is output from this data map region and the first data map output value is extrapolated from the first data map output values of the first data map points corresponding to said predetermined number of second data map points.

In another embodiment, the method further includes:

providing a third data map having a plurality of third data map points, and determining a control function for the injector based on the first data map output value, the second data map output value and a third table output value, wherein the third data map value is determined in accordance with criteria (a) and (b), as for the first data map output value.

The first and third data maps may be two dimensional tables of first and third data map points respectively and, more preferably, the second data map is a two dimensional table of second data map points.

The control function may typically be a waveform function for the injector, and preferably the one or more second data map points of the first type represent a first waveform and one or more of the second data map points of the second type represent a second waveform and thus the second data output value selected in accordance with (a) or (b) is a waveform.

In one embodiment the first data map output value represents a start time of the waveform of the second data map output value and the third data map output value represents a duration of the waveform of the second data map output value.

In a one embodiment the method includes applying the first or second waveform to the injector to initiate injection, said first and second waveforms preferably being drive current waveforms.

Thus, it is one method of the present invention to control operation of an injector including the following:

generating a first table having a plurality of first table points, each of the first table points representing a first table output value corresponding to a property of a waveform to be applied to the injector to initiate injection, generating a function map comprising a second table having a plurality of second table points, each of the second table points corresponding to a respective one of the first table points, one or more of the second table points being of a first type and representing a first waveform and one or more of the second table points being of a second type and representing a second waveform, wherein the second table is divided into at least a first region containing only points of the first type and a second region containing only points of the second type and wherein a portion of the second table defines a hysteresis region, and determining an operating point on an operating path within the second table in dependence upon first and second engine operating parameters and determining a waveform function to be applied to the injector based on a first table output value and a second table output value in accordance with the following criteria:

a) if the operating point in the second table lies in a part of the first region which is outside the hysteresis region, a second table output value is output from the second table corresponding to the first waveform and a first table output value is interpolated from the first table output values of the first table points adjacent to the first table point which corresponds to the operating point in the second table; or b) if the operating point on the second table lies in a part of the first region which is within the hysteresis region, then:

i) if the operating point in the second table entered the hysteresis region from a previous operating point on the operating path within the first region then a second table output value is output from the second table corresponding to the first waveform and a first table output value is interpolated from the first table output values of the first table points adjacent to the first table point which corresponds to the operating point in the second table; but ii) if the operating point in the second table entered the hysteresis region from a previous operating point on the operating path within the second region, a second table output value is output from the second table corresponding to the second waveform and a first table output value is extrapolated from the first table output values of the first table points adjacent to the first table point which corresponds to the previous operating point in the second table.

Typically, one of the first and second engine operating parameters represents engine load and one represents engine speed.

The method is typically implemented by an engine controller, the method including generating the first and second data maps within the controller itself.

The method may alternatively include generating a third table having a plurality of points, each of the points being a third table value corresponding to a further property of a waveform to be applied to the injector to initiate injection, wherein the waveform function to be applied to the injector is a combination of the first, second and third table output values, and wherein the third table output value is determined in accordance with criteria (a) and (b), with references to the first table being replaced with references to third table.

According to a second aspect of the invention there is provided a controller for controlling operation of an injector or the like suitable for use in an internal combustion engine, the controller including:

a first data map having a plurality of first data map points, each of the first data map points representing a first data map output value, a function map comprising a second data map having a plurality of second data map points, each corresponding to a respective one of the first data map points, and wherein the second data map is divided into at least a first-type data map region containing second data map points only of a first type and a second-type data map region containing second data map points only of a second type and wherein a portion of the second data map defines a hysteresis region, and a processor for determining an operating point on an operating path within the second data map in dependence upon first and second engine operating parameters, for determining a first data map output value from the first data map and a second data map output value from the second data map, in accordance with criteria (a) and (b) in claim 1, and for providing a control function to the injector based on the first and second data map output values.

The controller may be adapted to carry out the aforementioned search function of the method of the first aspect of the invention.

The controller may further comprise a third data map having a plurality of third data map points, wherein the third data map is divided into at least a first further region containing only points of a first further type and a second further region containing only points of a second further type, and wherein the processor is adapted for determining a third data map value in accordance with the criteria (a) and (b) and for providing a control function for the injector based on the first, second and third data map output values.

Said processor of the controller typically provides a control function for the injector in the form of a waveform function, and preferably the one or more second data map points of the first type represents a first waveform type and one or more of the second data map points of the second type represents a second waveform such that the second data output value selected in accordance with (a) or (b) is a waveform.

It will be appreciated from the following description that the controller of the second aspect of the invention may be configured to perform the preferred and/or optional steps of the method of the first aspect of the invention, alone or in appropriate combination.

According to a still further aspect of the invention, there is provided a carrier medium for carrying a computer readable code for controlling a processor, computer or other controller to carry out the method of the first aspect of the invention.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

In the following description, the term "engine load" is used as a synonym for "fuel demand" and takes the units of mg fuel. The term engine speed is used in the normal context and takes the units of rpm. Where different combinations of injections or part injections are used in each injection cycle, such combinations are referred to as injection cycle "types". The term "operating condition" is used to define a given combination of engine speed and load and the term "operating point" is used to define the instantaneous operating condition of the engine at any given time.

Figure 1:
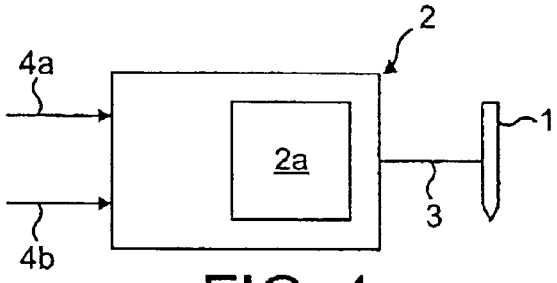
FIG. 1 illustrates a controller for controlling operation of an injector of a fuel injection system.

Referring to FIG. 1, a fuel injection system typically includes one or more fuel injectors 1 (one of which is shown in this example) controlled by means of an engine management system or controller 2 including a computer or processor 2*a*. The controller 2 is arranged to generate an injector control function 3, typically in the form of an electrical current, which is applied to the injector 1 to control the movement of an injector valve needle (not shown). In a unit injector, for example, the control function 3 takes the form of a current waveform that is applied to an electromagnetic actuator of a spill valve to control valve needle lift. The current is applied to the injector in the form of a waveform, and when the current in the waveform exceeds a predetermined threshold value, the valve needle of the injector is caused to open, thereby to inject fuel into the engine cylinder. When the current in the waveform decreases below the predetermined threshold value the valve needle is caused to close, thus halting any injection of fuel into the engine cylinder.

In order to optimise operation of the injectors, the waveform must be selected to start at the correct time and be of the correct duration. The timing and duration of the waveform 3 is generally dependent on two operating parameters: a first control parameter representative of engine load (as determined by the throttle position set by the driver) and a second operating parameter representative of engine speed. The two operating parameters are supplied to the controller 2 as inputs 4*a*, 4*b*, and the variation in the output values representing the start time and duration for the waveform 3 as one of these input operating parameters 4*a*, 4*b* changes can be illustrated in a graph, such as that shown in FIG. 2.

Figure 2:
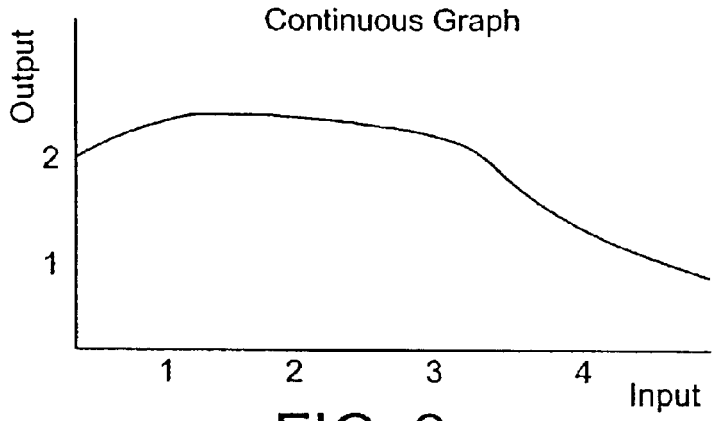
FIG. 2 illustrates graphically an example of a function for controlling a fuel injector.

In the example of FIG. 2, the graph has an ordinate axis defined by output values, each output value representing, for example, a start time for the waveform. The abscissa axis of the graph is defined by input values, each input value representing, for example, engine speed. Thus, the graph illustrates how the start time of a given waveform changes as the speed of the engine changes. It will be understood that the graph does not illustrate the actual waveform but merely the start times used by the waveform for particular engine operating conditions.

Figure 3:
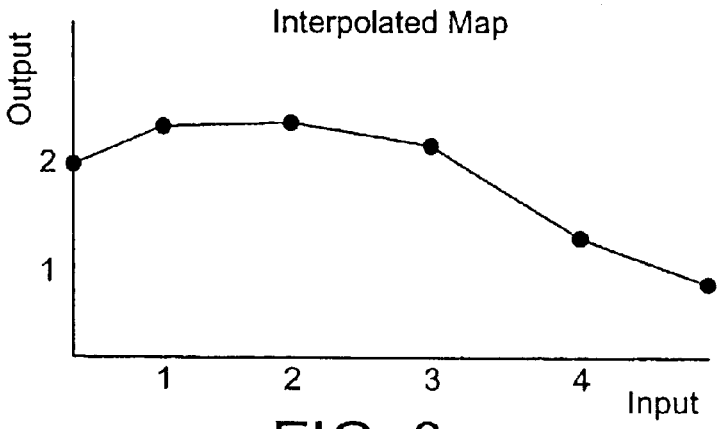
FIG. 3 illustrates how the function of FIG. 2 may be represented by an interpolated map.

In general, controllers or engine management systems 2 do not make use of such graphs as the infinite number of points on the graph makes its storage electronically impractical. Instead, it is usual for the line on the graph to be represented by a number of points, where values between points on the graph are calculated by means of interpolation. This type of graph is termed a "map" and an example of an interpolated map corresponding to the graph of FIG. 2 is shown in FIG. 3.

However, as stated above, the output value representing the start time of the waveform does not necessarily vary only with speed. Usually, it varies also with engine load. A separate graph or map is therefore required illustrating how the start time of the waveform changes as the engine load changes. In this instance, the abscissa axis is defined by input values representing engine load.

Figure 4:
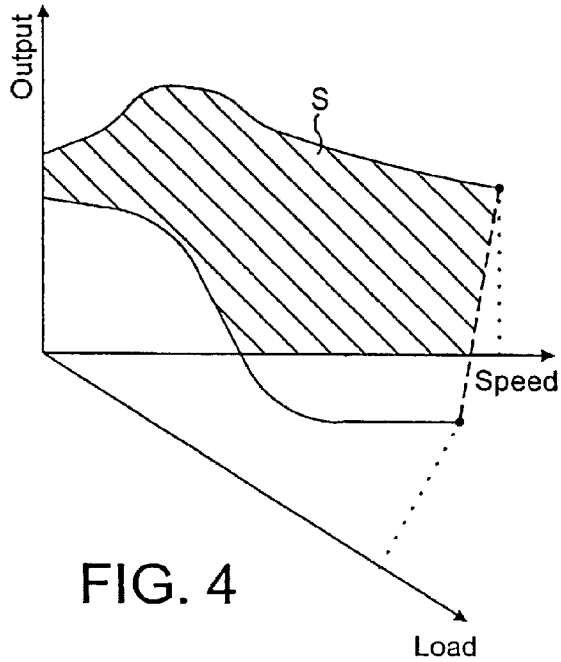
FIG. 4 illustrates a 3-dimensional map defining the function of FIG. 3 having two variables.

These two maps cannot be superimposed since their abscissa values are not identical. Instead, these must be illustrated in a three-dimensional map where the y-axis represents the output, the x-axis represents the input for engine speed and the z-axis represents the input for engine load. The function by which the output varies with engine load and engine speed is thus changed from a simple, one-dimensional line to a two-dimensional surface S as shown in FIG. 4.

Figure 5:
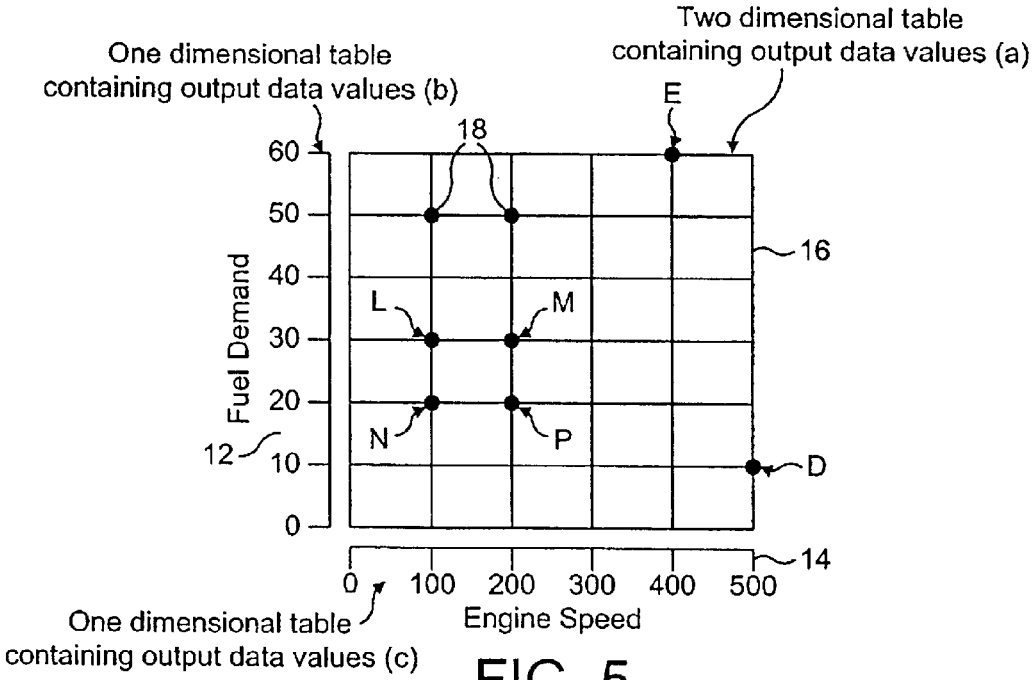
FIG. 5 illustrates how the 3-dimensional map of FIG. 4 may be represented by a two-dimensional table.

Such a two-dimensional function is most easily represented in the memory of the controller by means of a function map, an example of which is illustrated in FIG. 5.

The function map 10 comprises an algorithm (not shown), for implementation by the controller 2, and three maps or tables: a first one-dimensional table 12 containing discrete values representative of engine load, a second one-dimensional table 14 containing discrete values representative of engine speed and a two-dimensional table 16 having a plurality of points or output values 18 representative of the start time for the current waveform to be applied to the injectors. The function map is typically recorded in a computer/processor readable format on a carrier or storage medium of the controller 2 and is implemented by the controller 2 to control operation of the injectors in accordance with method steps defined by computer/processor readable code.

Each point in the two-dimensional table 16 thus has an output value, representative of the start time for the current waveform, corresponding to a given engine operating condition (i.e. a given combination of engine load and speed). By specifying discrete values of the engine load and speed (hereafter referred to as "input values"), the corresponding point, and hence the corresponding output value, may be determined from the two-dimensional table 16.

It will be appreciated that, since the first and second one-dimensional tables 12, 14 contain only a finite number of discrete input values, it is not possible to determine directly from the two-dimensional table 16 the point or output value corresponding to input values intermediate the discrete values in the first and second one-dimensional tables 12, 14. In calculating the appropriate output value corresponding to input values intermediate the discrete values in the first and second one-dimensional tables 12, 14, the algorithm takes the actual input values and derives the output value by means of interpolation, as shown in FIG. 6.

Figure 6:
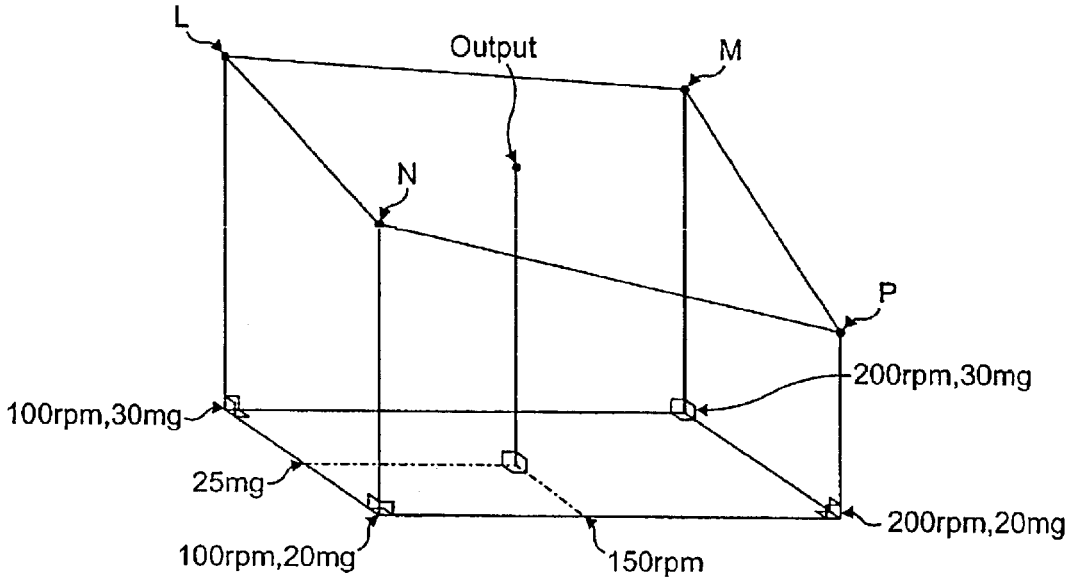
FIG. 6 illustrates diagrammatically the concept of interpolation.

In the example of FIG. 6, the input values to be used are 25 mg and 150 rpm respectively and the function map of FIG. 5 is used to calculate the corresponding output value. It can be seen from FIG. 5 that these input values fall intermediate the discrete values in the first and second one-dimensional tables 12, 14 respectively and that the corresponding position in the two-dimensional table 16 lies between the points having output values L, M, N and P.

By comparing the actual input values with the discrete values in the first and second one-dimensional tables 12, 14, the algorithm identifies the output values L, M, N and P as the relevant references for the interpolation. The output value, representative of the start time for the appropriate current waveform, is then interpolated from the output values L, M, N and P in the conventional manner and as illustrated in FIG. 6.

It will be understood that the surface defined by the output values L, M, N and P in FIG. 6 would form part of the surface S, were the function map of FIG. 5 to be illustrated as a three dimensional graph such as that shown in FIG. 4.

Figure 7:
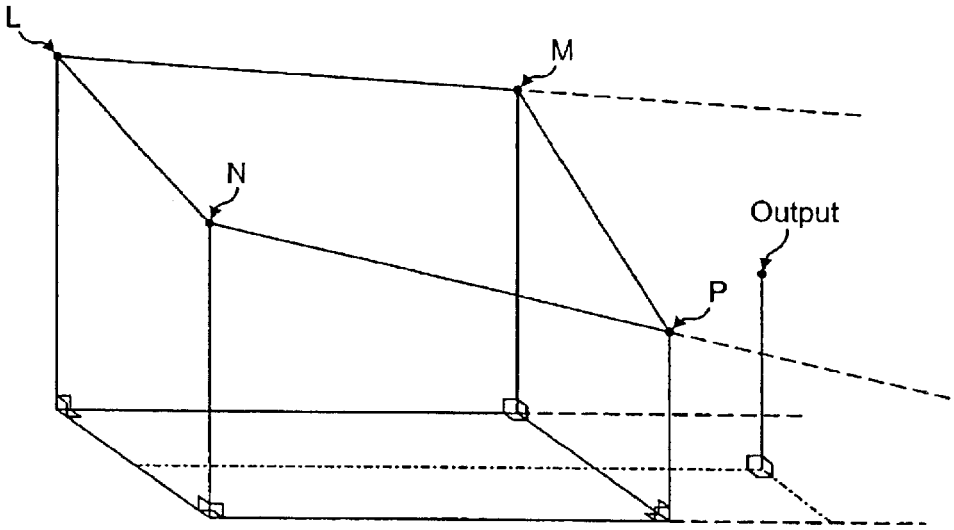
FIG. 7 illustrates diagrammatically the concept of extrapolation.

For certain engine operating points which fall at the edge of the two-dimensional table, for example at the operating points representing operating conditions of 10 mg and 500 rpm (point D in FIG. 5) or 60 mg and 400 rpm (point E in FIG. 5), interpolation may not work correctly since there are no output values on both sides of the operating point from which to interpolate. In such cases, extrapolation is used in the conventional manner and as illustrated in FIG. 7.

As the two-dimensional table 16 of FIG. 5 contains points having output values representative only of the start time for the waveform to be applied to the injectors, it will be understood that a second function map (not shown) having a two-dimensional table containing points having output values representative of the duration for the waveform, must also be used by the controller in order that the two parameters required by the waveform, that is to say start time and duration, can be calculated. In conventional controllers, therefore, two function maps are provided.

There are, in general, two main types of injectors used in combustion engines. These can broadly be referred to as single-valve injectors and multiple-valve injectors. Both types of injector are able to generate at least two types of injection cycle. For example, a first type of injection cycle may involve a single main injection while a second type of injection cycle may involve two main injections. Each type of injection cycle is defined by a particular waveform, otherwise known as a "pulse pattern".

Figure 8:
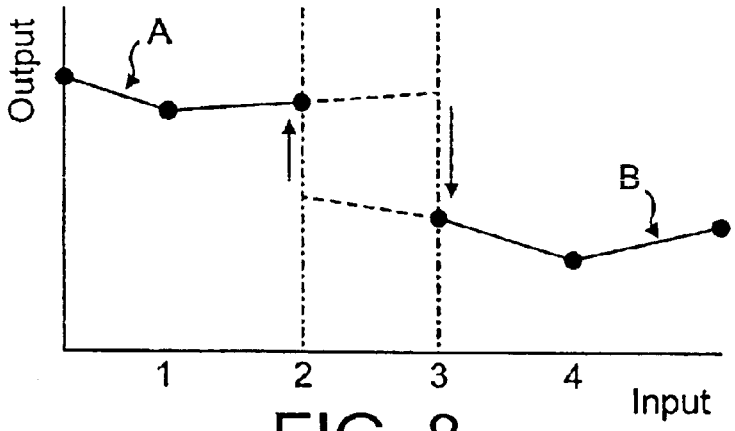
FIG. 8 illustrates how two functions may be represented on the same graph.

A common method of operating a single-valve injector is to have two different types of injection cycle. In a first type, a pilot injection precedes a main injection. In a second type, no pilot injection is used. There are thus two different waveforms or pulse patterns which may be used by the controller. Two or more types of injection cycle may be incorporated on a single graph as illustrated in FIG. 8. In this case the graph is a two-dimensional map in which the output values for two separate types of injection cycle are defined by the lines A and B. As in the case of FIGS. 2 and 3, the ordinate axis of the map of FIG. 8 is defined by output values representing the start time for the waveform, while the abscissa axis is defined by input values representing, in this case, engine speed. It can be seen that, at a particular engine speed, in this case 200 rpm, the injection cycle-switches between A and B.

Figure 9:
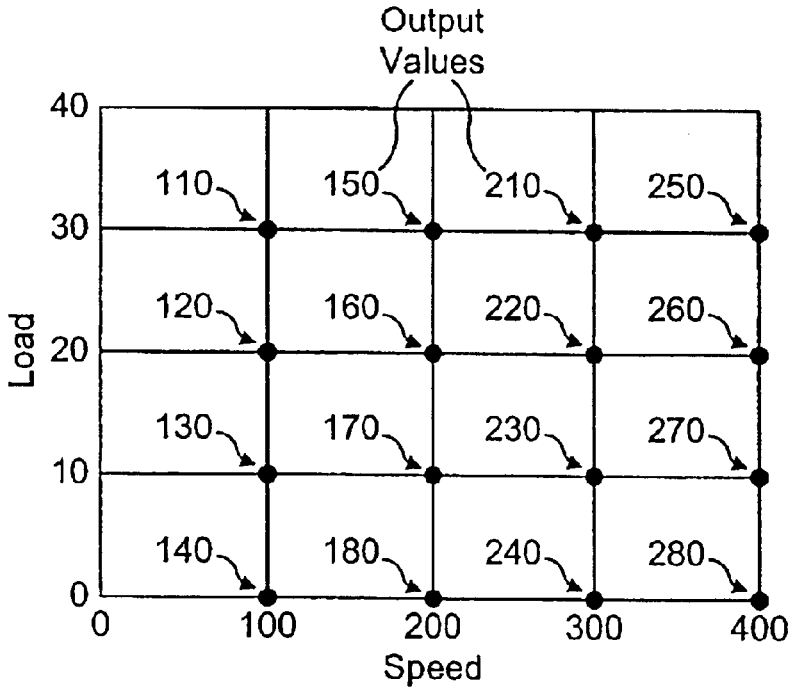
FIG. 9 illustrates how the graph of FIG. 8 may be represented by a two dimensional table.

This can be represented in a two dimensional table, as shown in FIG. 9. Here, the two-dimensional table contains sixteen points, each having a respective output value. However, the points corresponding to engine speeds less than or equal to 200 rpm have output values 110–180 which are relevant to the type of injection cycle A, whilst those points corresponding to engine speeds above 200 rpm have output values 210–280 which are relevant to the type of injection cycle B. The bold line in the table represents a transition point in the engine speed range when a transition is made between injection cycle type A and injection cycle type B.

It should be noted that the output values used in the table are merely representative and have no particular mathematical relationship with the values of the input variables.

It will be understood that the graph and table of FIGS. 8 and 9 provide for a transition between two types of injection cycle only in dependence on a single variable, in this case engine speed. Where a transition point is required for a second variable, such as engine load, it is extremely difficult to incorporate such an additional transition point in a single two-dimensional map.

This is further complicated in practice by the need to incorporate a hysteresis effect when switching between types of injection cycle, as described below.

It is often necessary to switch between the two types of injection cycle (i.e. to add or remove the pilot injection) at a particular engine speed. However, owing to the slight variation in torque which occurs when a pilot injection is added to, or removed from, an injection cycle (even if an identical quantity of fuel is removed from, or added to, the main injection), it is usually necessary to apply a hysteresis effect when switching between the two types of injection cycle (i.e. when adding or removing the pilot injection).

Specifically, in practice the engine speed at which the transition is made from the first type of injection cycle to the second is different to that at which the transition is made from the second type of injection cycle to the first. For example, the controller may switch from the first type of injection cycle to the second (i.e. the pilot injection is disabled or removed) when the engine speed drops below 600 rpm but may switch from the second type of injection cycle to the first (i.e. the pilot injection is enabled or added) when the engine speed rises above 610 rpm. There is thus an overlap between 600 and 610 rpm where the type of injection cycle to be used can be either the first type or the second type. The actual type of injection cycle used at engine speeds between 600 and 610 rpm will depend on the speed at which the engine was operating immediately before it entered this speed range.

Figure 10:
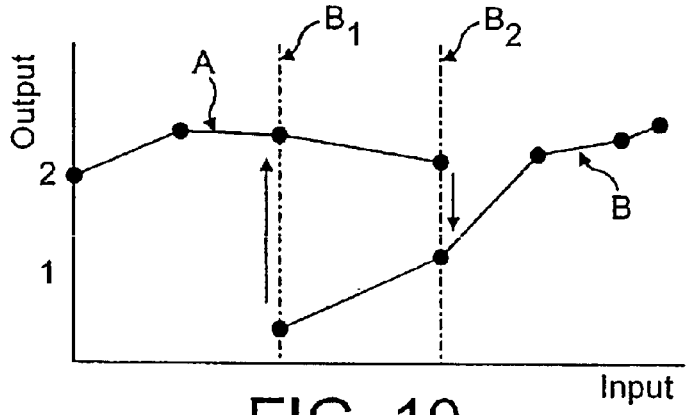
FIG. 10 illustrates the concept of hysteresis.

This situation is illustrated in FIG. 10 which shows a two-dimensional map in which the output values for two separate types of injection cycle are again defined by the lines A and B. As stated above, the lines A and B do not represent the shape of the waveforms which define the respective types of injection cycle. Rather, they merely represent the variation in the output values to be used for each waveform as the operating condition of the engine changes.

As in the case of FIGS. 2 and 3, the ordinate axis of the map of FIG. 10 is defined by output values representing the start time for the waveform, while the abscissa axis is defined by input values representing, in this case, engine speed. As can clearly be seen, the map includes a region, defined by the broken lines B1, B2 and lying on the abscissa axis between the values of 600 rpm and 610 rpm, where the output can take two possible values, depending on which type of injection cycle is used. This region is termed a hysteresis region or dead-band region, which is bounded or defined by the two transition points (also termed hysteresis points) and within which no transition between the first and second types of injection cycle A, B is made.

To clarify, suppose that at time T1, the engine is operating at 620 rpm. At this engine speed, it can be seen from the graph of FIG. 10 that the type of injection cycle used is type B since there is no output value for injection cycle type A at this engine speed.

At time T2, the engine speed has dropped to 605 rpm, at the centre of the hysteresis region. At this engine speed, there are output values corresponding to both injection cycle types A and B. However, because, as stated above, no transition between the first and second types of injection cycle is made while the engine speed is within the hysteresis region, the injection cycle type used remains type B.

At time T3, the engine speed has dropped further to 595 rpm. At this speed, there are no output values corresponding to injection cycle type B and so the transition is made from injection cycle type B to injection cycle type A.

At time T4, the engine speed has risen back to 605 rpm, at the centre of the hysteresis region. Again, because no transition between the first and second types of injection cycle is made while the engine speed is within the hysteresis region, the injection cycle type used remains type A.

Finally at time T5, the engine speed has risen further to 615 rpm. At this speed, as in the situation at time T1, the type of injection cycle used can only be type B and so the transition is made from injection cycle type A to injection cycle type B.

It will be understood that the transition from injection cycle type A to injection cycle type B actually occurs when the engine speed rises above 610 rpm while the transition from injection cycle type B to injection cycle type A occurs when the engine speed drops below 600 rpm.

When this two-dimensional map is applied to a three-dimensional map, such as that shown in FIG. 4, this type of "one-dimensional" hysteresis effect, where a hysteresis region is defined on a graph having only one variable (in this case engine speed), is relatively easily defined. However, the hysteresis, it will be noted, is only applied in respect of the engine speed. No hysteresis effect nor, in fact, any transition point, is applied with respect to engine load. This is very common and is generally acceptable for single-valve injectors where each injection or part injection within a given injection cycle does not affect the others.

For more modern injector types, for example two-valve injectors having a needle control valve and a spill valve, an important difference in their operation compared with single-valve injectors is that when multiple part injections are used within one injection cycle, each injection is affected by the part injection (or injections) which precedes it. Consequently, the output values for the start time and the duration of the injection cycle, and hence of the current waveform to be applied to the injectors, will vary not just with engine speed and engine load but also with the number of injections used within one injection cycle. In other words, the output values in the function maps for given input values will differ depending on the type of injection cycle used.

Using a two-valve injector, it is beneficial to change the type of injection cycle at different engine speeds and loads. In fact, there are many different types of injection cycle which may be used with a two-valve injector, each of which may possess properties which are beneficial in certain engine operating conditions. To optimise control of the injectors, it is necessary to switch from one type of injection cycle to another (i.e. from one waveform to another), in dependence upon both engine speed and load.

In order to achieve this effectively, however, and to optimise the operation of the injectors, it is necessary to define transition points or boundaries, where the type of injection cycle is changed, both in respect of engine speed and load. Furthermore, it is necessary to apply a hysteresis effect not only to the engine speed variable but also to the engine load variable. Because this hysteresis effect must be applied to two axes of a three-dimensional map (e.g. the x- and z-axes of FIG. 3) as opposed to one axis of a two dimensional one (e.g. as shown in FIG. 9), it is hereafter referred to as "two-dimensional hysteresis".

Implementation of two-dimensional hysteresis using existing methods is extremely difficult. The hysteresis region (i.e. the region of overlap on the graph) changes from a two dimensional surface to a three-dimensional volume which is difficult to define mathematically. Moreover, where there are more than two types of injection cycle, the definition of the hysteresis volume becomes even more complex.

In practice, therefore, either one-dimensional hysteresis has been used to control two-valve injectors which results in non-optimised operation of the injectors, or otherwise a set of maps has been used for each type of injection cycle. In this context, a "set" refers to a plurality of maps representing, for example, timing/advance, duration, pressure, closing pressure etc. Furthermore, the conventional one-dimensional hysteresis algorithm can work on engine speed or on fuel demand but not on both variables at the same time. Thus, the implementation of two-dimensional hysteresis is computationally expensive and technically difficult.

It would be advantageous to provide a method whereby only a single set of maps is required, thus reducing the required memory for storing the map, which allows two-dimensional hysteresis to be implemented and which contains information relating to a number of different types of injection cycle.

Figure 11:
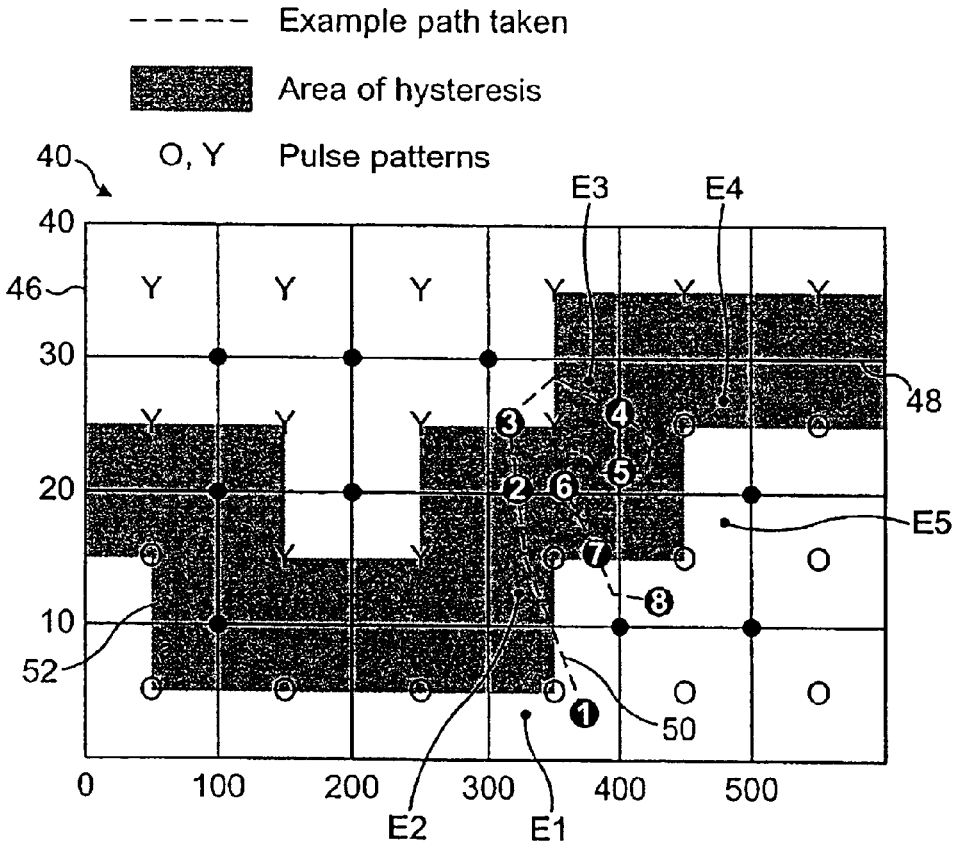
FIG. 11 illustrates a preferred form of function map according to the invention.

Referring next to FIG. 11, a preferred form of function map according to the invention, hereafter referred to as "the Function Map", is shown generally at 40. The Function Map includes a main algorithm and a data map or data store in the form of a two-dimensional data table 46, comparable with the two-dimensional table 16 shown in FIG. 5. The Function Map 40 includes a further data map in the form of respective first and second one-dimensional data maps or tables 12, 14, representative of operating parameters in the form of engine speed and engine load respectively. For clarity, the data maps in the form of the first and second one-dimensional data maps or tables 12, 14 are not shown in FIG. 11.

As seen in FIG. 11, each point on the two-dimensional table 46 has an output value, hereafter termed "cycle value", which corresponds to one of two different types of data map region, or injection cycle types, these being denoted Y and O respectively. Each point on the two-dimensional table 46 (i.e. the "data map point" or "data map value") is the centre point of the element, rather than the intersection between grid lines. The table 46 is divided into two general regions, a first data map region in which all of the data map points have a Y cycle value and a second data map region in which all of the data map points have a O cycle value. The table 46 is shown as having a plurality of cells or elements. This is for illustrative purposes only and it will be understood that each element or cell represents a single data map point or value, even though there will be other possible engine conditions in between these data map points in practice, with all possible engine conditions within a given element having the same injection cycle value (O or Y).

It will be understood that the two-dimensional table 46 may include data map points having output values corresponding to more than two injection cycle types, in addition to O and Y type.

Each data map point on the table 46 has a corresponding point on each of two additional function maps (not shown). Each additional function map is similar to that shown in FIG. 5 and includes a further respective algorithm or routine and a two-dimensional table, having the same axes as the table 46 and comprising a plurality of points having output values representative of the start time or the duration of the waveform respectively.

The cycle value in the table 46 is used by the Function Map 40 to indicate to the associated algorithm two properties:

a) which type of injection cycle Y or O is required (i.e. which waveform is to be used); and b) from which points in the respective additional function maps the output values for the start time and duration of the waveform are to be calculated, either by an interpolation algorithm or an extrapolation routine.

The interpolation and extrapolation routines associated with the additional function maps, and the main algorithm of the Function Map 40, are typically implemented in software and stored on a carrier medium for use with the controller 2. The interpolation and extrapolation algorithms or routines may form part of the main algorithm. Typically, the data maps 12, 14, 46 of the Function Map will be stored in a storage medium of the controller 2, for access and manipulation by the algorithms of the Function Map.

The two-dimensional data table 46 and the first and second one-dimensional data tables 12, 14 of the Function Map may, but need not, include data generated by the manufacturer of the controller 2 or the provider of the Function Map algorithm. It may be, for example, that a supplier other than the manufacturer of the controller 2 and/or the provider of the Function Map algorithm provides the data tables or maps 46, 12, 14.

Referring again to FIG. 11, the arrangement of Y and O elements, i.e. points having cycle values of Y or O, in the table 46 thus illustrates how the controller is to switch between types of injection cycle as the operating range of the engine varies, i.e. with engine speed and load. The bold line 48 in the two-dimensional table 46 is hereafter termed a "transition line" and defines the transition points in the engine operating range at which the injection cycle is changed from the first type (Y) to the second type (O). It can be seen, therefore, that the transition line defines the boundary between the first data map region and the second data map region on the table 46.

The dashed line 50 in the two-dimensional table 46 is hereafter termed an "operating path" and represents the variation in the operating condition of the engine over a period of time between, say, T1 to T7. Each of the operating points numbered 1 to 7 on the operating path 50 corresponds to the engine operating condition at times T1 to T7, respectively. Thus, for example, between times T1 and T2, the operating point changes from point 1 to point 2 on the Function Map 40, and so on.

The shaded region 52 shown on the table 46 represents a hysteresis or "dead band" region. It will be seen that the hysteresis region 52 substantially follows the transition line 48. However, it will further be seen that the hysteresis region 52 extends over a portion of the elements, i.e. a range of points, either side of the transition line 48 such that the transition line 48 substantially corresponds to the centre line of the hysteresis region 52.

The operating point represents the instantaneous operating condition of the engine, and as this moves around the two-dimensional table 46 of the Function Map the algorithm determines the cycle value corresponding to the operating point. In turn the cycle value is used to determined which waveform is to be used (O or Y) and which points in each of the additional function maps are used to calculate the output values for generating the start time and duration of the waveform, either using an interpolation algorithm or an extrapolation algorithm. Having determined the type of waveform to be used, it is thus necessary to determine the start time at which the waveform is applied, and the duration for which the waveform is applied. A combination of the waveform type (O or Y), the waveform start time and the waveform duration may conveniently be referred to as "a waveform function".

For example, if the operating point on the table 46 lies in the first region, i.e. it has a Y cycle value, the algorithm generally selects the waveform corresponding to the Y type of injection cycle, identifies the corresponding operating points on each of the additional function maps (one for start time and one for duration) and calculates, by means of an interpolation algorithm, the output values for the start time and duration of the waveform 3, as described above with reference to FIGS. 1 to 3. In the illustration shown in FIG. 11, for the purpose of identifying the corresponding points in each of the additional maps it will be appreciated that it is the approximate centre point of each element of table 46 that is used, and not the points of intersection between the horizontal and vertical grid lines of the table 46.

If, rather than lying within the first region, the operating point on the table 46 lies in the second region, i.e. it has an O cycle value, as an alternative step the algorithm generally selects the waveform corresponding to the O type of injection cycle, identifies the corresponding operating points on each of the additional function maps and calculates, by means of an interpolation algorithm, the output values for the start time and duration of the waveform 3 as described above with reference to FIGS. 1 to 3.

The Function Map 40 also contains an additional control element. The hysteresis region 52 in the two-dimensional table 46 defines a region within the operating condition envelope in which no transition between the first and second types of injection cycle Y, O occurs.

Considering firstly the engine condition at time T1, the operating point 1 lies within the second region, in an element labelled E1, and thus has a cycle value O, meaning that the injection cycle, and hence waveform, to be used is type O. Having determined the type of waveform to be used, it is then necessary to determine the start time at which the waveform is applied, and the duration for which the waveform is applied. A combination of the waveform type (O or Y), the waveform start time and the waveform duration may conveniently be referred to as "a waveform function".

In order to determine the start time, the algorithm identifies the point on the additional start time map corresponding to the operating point 1 and uses an interpolation method, based on output values from points in the start time map adjacent to the operating point, to calculate the appropriate output value for start time. Similarly, in order to determine the duration, the algorithm identifies the corresponding operating point on the additional duration map and uses an interpolation method, based on output values from points on the duration map adjacent to the operating point, to calculate the appropriate output value for duration.

Between times T1 and T2, the operating point moves from the element E1 into the element E2. The operating point 2 is still in the second region and thus has a cycle value O. At all times between times T1 and T2 therefore, the controller determines that the waveform to be used is type O. The algorithm then identifies the corresponding operating point on each of the additional maps (one for start time, one for duration) and applies an interpolation method, based on output values from the points on the start time and duration maps adjacent the operating point, to calculate the appropriate output value, as described above.

Between times T2 and T3, the operating point crosses the transition line 48 into an element labelled E3. Element E3 lies in the first region and thus the operating point 3 has a cycle value Y. However, the operating point remains at all times within the hysteresis region 52. Since the operating point has at no time moved out of the hysteresis region 52, no transition from injection cycle type O to injection cycle type Y is made. Instead, the controller continues to generate the waveform O.

Furthermore, the algorithm then identifies the corresponding operating point on each of the additional maps but, rather than interpolating from the points surrounding the operating point in the additional maps as discussed above, the algorithm calculates the appropriate output values by an extrapolation method based on output values from those points in the previous element E2 which are closest to the operating point, in the manner described with reference to FIG. 7.

Between times T3 and T4, the operating path remains within the element E3 in the first region and thus has a cycle value Y, but for a period of time exceeds the boundary of the hysteresis region 52. When the operating point moves out of the hysteresis region 52, the controller determines that the type of injection cycle, and hence the waveform, to be used is to switch to type Y. Thus, the injection cycle of the engine changes from O to Y. The algorithm then identifies the corresponding operating point on each of the additional maps and derives the start time and duration of the waveform by interpolation based on output values from the points adjacent to, or surrounding, the operating point.

Even when the operating point moves back into the hysteresis region 52 (e.g. at the midpoint of the operating path between points 3 and 4 on the table 46), the waveform used by the controller remains at type Y and the output values of start time and duration are still interpolated from the output values of the points adjacent to the operating point.

Between times T4 and T5, the operating point re-crosses the transition line 48 from the element E3 in the first region to the element E4 in the second region. The operating point thus has a cycle value O. However, during this time interval, the operating point remains at all times within the hysteresis region 52. Since the operating point has at no time moved out of the hysteresis region 52, no transition from injection cycle type Y to injection cycle type O is made, despite the fact that the operating point lies in the second region, i.e. in an element having a cycle value O.

The controller therefore continues to generate the waveform Y. Furthermore, the algorithm identifies the corresponding operating point on each of the additional maps (start time and duration) but, rather than interpolating the output values as described above, it calculates the output values by an extrapolation method based on output values from those points in the previous element E3 which are closest to or neighbouring the operating point, in the manner described with reference to FIG. 7.

Between times T5 and T6, the operating point crosses the transition line 48 back into the previous element E3 having a cycle value Y. Again, however, since the operating point has at no time moved out of the hysteresis region 52, no transition from injection cycle type Y to injection type O is made. Instead, the controller continues to generate the waveform Y. Furthermore, the algorithm identifies the corresponding operating point on each of the additional maps and calculates the output values (start time and duration) by interpolation based on the output values of the points adjacent to or surrounding the operating point.

Between time intervals T6 and 17, the operating point crosses the transition line 48 from the first region to the element E2 in the second region. The operating point thus has a cycle value O. However, again the operating point remains at all times within the hysteresis region 52. Since the operating point has at no time moved out of the hysteresis region 52, no transition from injection cycle type Y to injection cycle type O is made. Instead, the controller continues to generate the waveform Y. The injection cycle type thus remains as type Y.

Furthermore, the algorithm identifies the corresponding operating point on each of the additional maps but, rather than interpolating from the output values of the points adjacent to the operating point, the algorithm calculates the output values (start time and duration) from each of the additional maps by an extrapolation method based on output values of those points in the previous element E3 which are closest to or neighbouring the operating point, in the manner described with reference to FIG. 7.

Finally, between times T7 and T8, the operating point moves from within the element E2 to within the element E5, and thus remains having a cycle value O. In doing so, the operating point exceeds the boundary of the hysteresis region 52. When the operating point moves out of the hysteresis region S2, the controller determines that the type of injection cycle, and hence the waveform, to be used is to switch back to type O. Thus, the injection cycle of the engine changes from Y to O.

The algorithm then identifies the corresponding operating point on each of the additional maps and calculates the output values for the start time and duration of the waveform by interpolating from the output values of the points adjacent to or surrounding the operating point.

The method by which the algorithm selects the points in the additional maps that are adjacent to or neighbouring the point in each map corresponding to the current operating point, and hence the points for which the output values are used for the interpolation or extrapolation routine, is used in known map strategies and would be familiar to a person skilled in that field.

It will be appreciated that the effect of the hysteresis region 52 is to increase the thickness of the transition line such that the injection cycle changes only when the engine operating condition moves from a position within the hysteresis region to a point outside the hysteresis region. Since the hysteresis region is two-dimensional, the hysteresis effect is applied in exactly the same manner when the engine condition changes in load, engine speed or both.

Figure 12A:
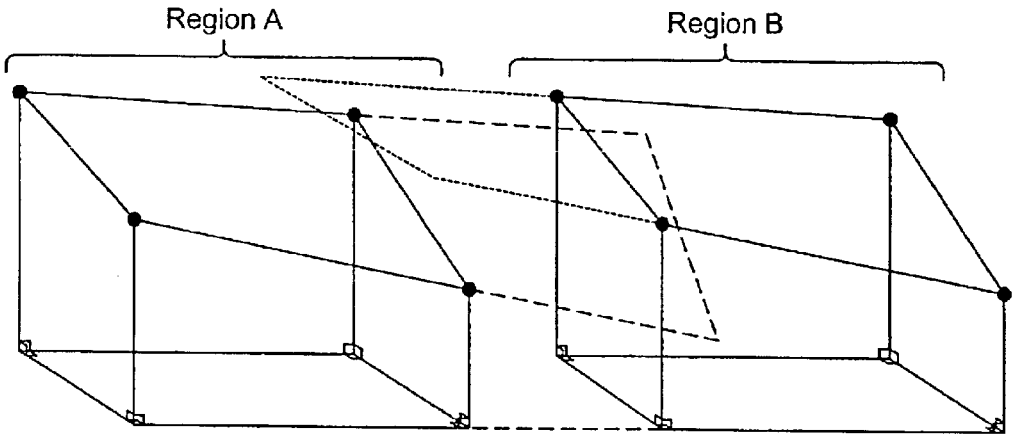
FIG. 12 illustrates diagrammatically the interpolation and extrapolation implemented by the function map of FIG. 11.
Figure 12B:
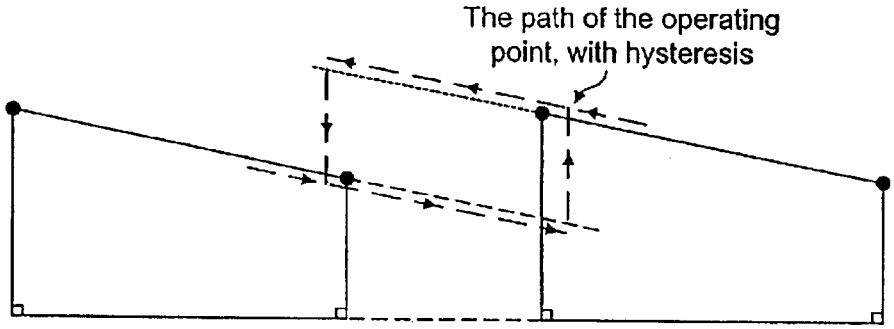

Referring to FIG. 12, this illustrates diagrammatically the concept of the hysteresis region. Two adjacent elements are shown, a Y element and an O element, with the surfaces of each region extended (extrapolated) such that the extended parts of each element overlap the adjacent element. The area (or volume) defined by the overlapping part is equivalent to the hysteresis region 52. This is also depicted in conventional form in FIG. 12*b*.

Figure 13:
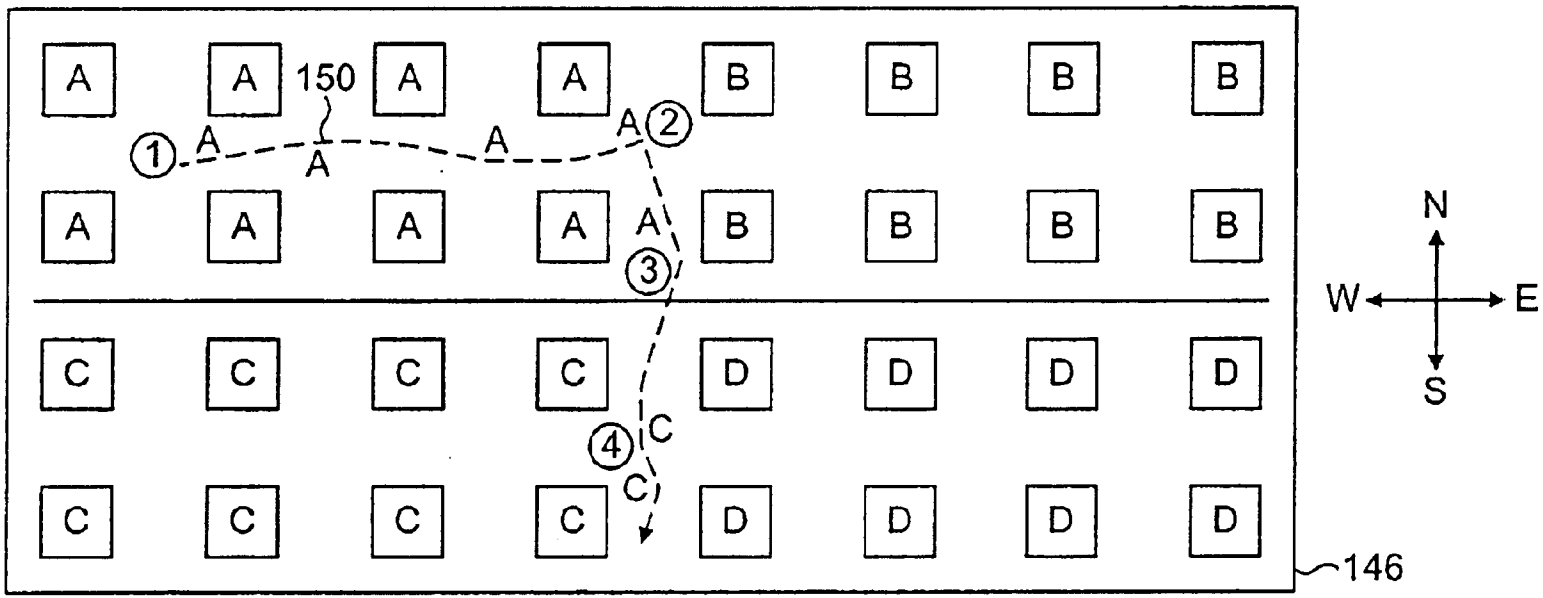
FIG. 13 is an alternative function map to that shown in FIG. 11.

As mentioned previously, the data map may include a two-dimensional table with points having output values corresponding to more than two injection cycle types. With reference to FIG. 13, for example, there is shown a Function Map having four different injection cycle types: A, B, C and D. The operating path 150 shown as a dashed line in FIG. 13 is functionally equivalent to the operating path 50 in FIG. 11. A solid line represents a transition line (horizontal) defining the border between the regions of A and B type injection cycle and C and D type injection cycle. It will be appreciated that a transition line (vertical) also exists between regions of A and C type injection cycle and B and D type injection cycle, but for clarity this is not shown.

The operating path 150 in FIG. 13 is initially passing, between times T1 and T2, through a region of a data map or table 146 where an A type injection cycle, and hence waveform, is to be used. As described previously, having determined the type of waveform to be used at each operating point the start time at which the waveform is applied, and the duration for which the waveform is applied, must be determined. In order to determine the start time the algorithm identifies the point on the additional start time map corresponding to the operating point and uses an interpolation method. The interpolation method takes as its interpolation points those points in the additional start time map corresponding to the points in the table 146 adjacent to or neighbouring the operating point, and uses these corresponding points to calculate by interpolation the appropriate output value for the start time.

Similarly, in order to determine the duration, the algorithm identifies the points on the additional duration map corresponding to the points in the table 146 adjacent to or neighbouring the operating point, and uses these corresponding points to calculate by interpolation the appropriate output value for the duration.

Between times T2 and T3 the operating path 150 passes over the transition line between the region of A type injection cycle and the region of B type injection cycle, but at no time leaves the hysteresis region (not identified for clarity). Thus, the transition from injection cycle A to injection cycle B does not take place and instead the controller continues to generate the waveform A using extrapolation. At each operating point on the operating path 150 between times T2 and T3 the algorithm identifies the corresponding operating point on each of the additional maps and, rather than interpolating from the points surrounding the operating point in the additional maps, calculates the appropriate output values by an extrapolation method based on output values from those points at the previous operating which are closest to or neighbouring that operating point (i.e. A type in this case). This method is as described previously for FIG. 11, and O and Y type injection cycles.

It is notable in FIG. 13, however, that at time T3 the operating path 150 crosses the transition line separating the upper region of the table 146 from the lower region (i.e. the region containing A and B type injection cycles from the region containing C and D type injection cycles), even though, once again, the operating path 150 does not leave the hysteresis region. At time T3 (and later) it is not appropriate to extrapolate from points of injection cycle type A as this is no longer the injection cycle type representative of the points neighbouring the current operating point. Instead it is appropriate for the algorithm to find the injection cycle type of the points neighbouring, or adjacent to, the current position of the operating path 150, and to use these points to extrapolate the output values for start time and duration.

It can be seen in FIG. 13 that as the operating path 150 crosses the transition line from that part of the hysteresis region between A and B type injection cycles (A/B hysteresis region) and that part of the hysteresis region between C and D type injection cycles (C/D hysteresis regions), the algorithm makes a transition from injection cycle type A to injection cycle type C. Injection cycle type C is selected as being the appropriate injection cycle type as this is the injection cycle type for points of the table 146 neighbouring or adjacent to the current operating point (as opposed to using the injection cycle type on the previous operating point within the hysteresis region, which, in this example, would be A).

To clarify this further, at each operating point along the path 150 the algorithm performs a search function, or search routine, including two phases. In the first phase, the search routine determines the direction of the previous operating point relative to the current operating point. In the second phase, the search routine analyses the type of injection cycle in data map regions of the table 146 in, say, up to eight directions, starting from the determined direction (that is, the direction of the previous operating point relative to the current operating point), and then searching sequentially through several other directions until a data map region is found to contain four points representative of data map values of like injection cycle type. The search routine may, of course, only need to search in one or two, say, of the total of eight directions, if the first or second searched direction contains a region having four like data map values (i.e. four values in a 2×2 formation having a common injection cycle type).

Typically, the algorithm searches for the injection cycle type in regions of the table 146 in the following sequence of directions (with N as north, S as south, W as west and E as east, as identified in FIG. 13): N, NW, NE, W, E, SW, SE, S. In each direction that is searched the search algorithm looks for four points representing data map values of like type, and when this region is found it is this injection cycle type that is adopted for the current operating point. These four data map points representing like cycle type are then used to locate the corresponding points on the additional maps from which the output values for the waveform start time and duration are determined by extrapolation.

To best illustrate this search process in detail, consider that the operating point is at time T3 in FIG. 13, approximately at a point of transition between the A/B and C/D hysteresis regions. In the first phase of the search routine, it is determined that the previous operating point on the path 150 (i.e. at time T2) is in direction N (or "up") relative to the current operating point (i.e. at time T3). For the second phase of the search routine, the algorithm starts in the N direction and identifies the types of data map value in this direction, this being a combination of A and B type injection cycles. As four data map values of like type are not found in the N direction, the second phase of the search routine continues and the algorithm next searches in the NW direction. Here the algorithm finds four data map values of like type, being A type, and hence it is confirmed that the appropriate cycle type is A. This will be consistent with the algorithm having identified cycle type A as being the appropriate cycle type, as the operating path has not left the hysteresis region between times T2 and T3 and the previous operating point was of cycle type A (time T2). As before, therefore, at time T3 the output values from the additional maps, to determine the start time and duration of the A type waveform, are extrapolated from the points on the start time and duration maps respectively which correspond to the these four data map points of the table 146.

At the next operating point on the operating path 150, at time T4, the first phase of the search algorithm is performed and identifies the direction of the previous operating point (at time T3) relative to the current operating point (at time T4) as being in the N direction. In the second phase of the search algorithm, a check is first made of the four data map points in the N direction, and these are found to have a combination of A and C type cycle values (i.e. not four data map points representing injection cycle values of like type). A check is then made in the next direction in the sequence, direction NW, again finding a combination of A and C type cycle values. Then, at the next step of the search, B and D type cycle values are found in direction NE. The next step of the search, in direction W, finds four data map points representing like cycle values, this being type C. The algorithm therefore identifies injection cycle type C as the appropriate cycle type at time T4. These four points are then used to identify the corresponding points on the additional maps for start time and duration that are used in the extrapolation algorithm to calculate the start time and duration output values.

For continuing progress of the operating path 150 through the hysteresis region from time T4, it can be seen that the path 150 continues to proceed in a generally S direction and continues to move between data map points having injection cycle type C and D. At each operating point the search algorithm is performed, resulting in a C type cycle value being maintained so that the selected injection cycle type remains as type C. Extrapolation from the points in the additional maps corresponding to these four data map points of C type cycle value is then used to determine the start time and duration of injection cycle waveform type C, as described previously.

The method of determining the appropriate injection cycle type by using data map points "neighbouring" the current operating point to derive the injection cycle type and the extrapolation values for the additional maps, in circumstances in which the operating path 150 moves through the hysteresis region between neighbouring data map points of different type (e.g. A/B and C/D), and hence over-riding the step of extrapolation from the previous operating point in the hysteresis region, is a preferred additional feature of the method described previously. It will therefore be appreciated that it may, but need not, be incorporated in the Function Map algorithm.

Although the method steps described with reference to FIG. 13 refer to a search being carried out for four data map points of the table 146 having a like injection cycle type, it will be appreciated that three or five points of like injection cycle type may be the level required to identify the appropriate region. Likewise the search routine may be carried out in less than 8 directions, for example 4 directions, or in more than 8 directions, for example 12 or 16 directions.

It will be appreciated that the present invention allows two-dimensional hysteresis to be implemented. Furthermore, only a single pair of additional maps (one for start time and one for duration of the waveform) are required, regardless of the number of different types of injection cycle which are to be used with the injectors. The storage space within the controller is thus significantly reduced.

It will appreciated from the foregoing description that whilst the method described refers to the selection of an injection cycle type, or waveform, and thus output values representative of start time and duration of the waveform, the method is equally applicable to other injector control parameters, not necessarily a drive waveform for an electromagnetically actuable valve needle.

The method may also be applied to automatic gearbox control, where the input engine operating parameters may be engine speed and load. Alternatively, the method may be applied to brush-less DC motor control, where it may be required to reconfigure the electromagnetic windings to change dynamically the number of poles.

It will thus also be appreciated by a skilled reader of this document that the method described is equally applicable to device control outside of the field of fuel injection, and indeed beyond the automotive field.

Obviously, many modifications and variations of the present invention are possible in light of the above teachings. The invention may be practiced otherwise than as specifically described within the scope of the appended claims.

What is claimed:

1. A method of controlling an injector suitable for use in an internal combustion engine, the method including:

providing a first data map having a plurality of first data map points, each of the first data map points representing a first data map output value;

providing a function map comprising a second data map having a plurality of second data map points, each corresponding to a respective one of the first data map points, and wherein the second data map is divided into at least a first-type data map region containing second data map points representing second data map output values only of a first type and a second-type data map region containing second data map points representing second data map output values only of a second type, wherein a portion of the second data map defines a hysteresis region; and, determining an operating point on an operating path within the second data map in dependence upon first and second engine operating parameters and determining a control function for the injector based on a first data map output value determined from the first data map and the second data map output value determined from the second data map, in accordance with the following criteria:

a) if the operating point in the second data map lies in a part of the first-type data map region which is outside the hysteresis region, the second data map output value is output from the first-type data map region and the first data map output value is interpolated from first data map output values of the first data map points adjacent to or neighbouring the first data map point corresponding to the operating point in the second data map; or b) if the operating point in the second data map lies in a part of the first-type data map region which is within the hysteresis region, then:

i) if the operating point in the second data map entered the hysteresis region from a previous operating point on the operating path within the first-type data map region then the second data map output value is output from the first-type data map region and a first data map output value is interpolated from the first data map output values of the first data map points adjacent to or neighbouring the first data map point corresponding to the operating point in the second data map; but ii) if the operating point in the second data map entered the hysteresis region from a previous operating point on the operating path within the second-type data map region, then the second data map output value is output from the second-type data map region and the first data map output value is extrapolated from the first data map output values of the first data map points adjacent to the first data map point corresponding to the previous operating point in the second data map.

2. A method as claimed in claim 1, wherein (b) further includes:

performing a search function including determining a direction of the previous operating point relative to a current operating point and analysing the type of data map region in said direction to check whether at least a predetermined number of second data map points in said region represent second data map output values of like first or second type; and, (iii) if at least the predetermined number of second data map points in said region in said direction have second data map output values of like first or second type then the second data map output value is determined in accordance with (b)(i) or (ii), but (iv) if less than the predetermined number of second data map points in said region in said direction represent second data map output values of like type then the type of data map region in at least one further direction is analysed until a data map region having at least the predetermined number of second data map points representing second data map output values of like type is found, and then the second data map output value is output from this data map region and the first data map output value is extrapolated from the first data map output values of the first data map points corresponding to said predetermined number of second data map points.

3. A method as claimed in claim 2, wherein the search function includes analysing the data map region in up to eight directions, in sequence, until a data-type region having at least four second data map points representing second data map output values of like type is located for the purpose of determining the first and second data map output values.

4. A method as claimed in claim 1, including providing a third data map having a plurality of third data map points, and determining a control function for the injector based on the first data map output value, the second data map output value and a third table output value, wherein the third data map value is determined in accordance with criteria (a) and (b), as for the first data map output value.

5. A method as claimed in claim 4, wherein the first and third data maps are two dimensional tables of first and third data map points respectively.

6. The method as claimed in claim 4, wherein the second data map is a two dimensional table of second data map points.

7. The method as claimed in any claim 4, wherein the control function is a waveform function for the injector.

8. The method as claimed in claim 7, wherein the one or more second data map points of the first type represents a first waveform and one or more of the second data map points of the second type represents a second waveform and thus the second data output value selected in accordance with (a) or (b) is a waveform.

9. The method as claimed in claim 8, wherein the first data map output value represents a start time of the waveform of the second data map output value.

10. The method as claimed in claim 8, wherein the third data map output value represents a duration of the waveform of the second data map output value.

11. The method as claimed in claim 8, further comprising applying the first or second waveform to the injector to initiate injection.

12. The method as claimed in claim 11, wherein the first and second waveforms are drive current waveforms.

13. The method as claimed in any claim 1, wherein one of the first and second engine operating parameters represents engine load.

14. The method as claimed in claim 1, wherein one of the first and second engine operating parameters represents engine speed.

15. The method as claimed in claim 1, when performed by a controller, the method including generating the first and second data maps within the controller.

16. A carrier medium for carrying a computer readable code for controlling a processor or computer to carry out the method of claims 1.

17. A controller for controlling operation of an injector suitable for use in an internal combustion engine, the controller including:

a first data map having a plurality of first data map points, each of the first data map points representing a first data map output value;

a function map comprising a second data map having a plurality of second data map points, each corresponding to a respective one of the first data map points, and wherein the second data map is divided into at least a first-type data map region containing second data map points representing second data map output values only of a first type and a second-type data map region containing second data map points representing second data map output values only of a second type and wherein a portion of the second data map defines a hysteresis region; and, a processor for determining an operating point on an operating path within the second data map in dependence upon first and second engine operating parameters, for determining a first data map output value from the first data map and a second data map output value from the second data map, in accordance with criteria (a) and (b) in claim 1, and for providing a control function to the injector based on the first and second data map output values.

18. The controller as claimed in claim 17, further comprising a third data map having a plurality of third data map points, wherein the third data map is divided into at least a first further region containing only points of a first further type and a second further region containing only points of a second further type, and wherein the processor is configured for determining a third data map value in accordance with the criteria (a) and (b) and for providing a control function for the injector based on the first, second and third data map output values.

19. The controller as claimed in claim 17, wherein said processor provides a control function for the injector in the form of a waveform function.

20. The controller as claimed in claim 19, wherein the one or more second data map points of the first type represents a first waveform type and one or more of the second data map points of the second type represents a second waveform such that the second data output value selected in accordance with (a) or (b) is a waveform.

21. The controller as claimed in claim 17, wherein one of the first and second engine operating parameters represents engine load or engine speed.

* * * * *